United States Patent [19]

Guaraldi

[11] Patent Number: 4,458,591

[45] Date of Patent: Jul. 10, 1984

[54] ROTARY PRINTING PRESS

[75] Inventor: Glenn A. Guaraldi, Wood River Junction, R.I.

[73] Assignee: Harris Graphics Corporation, Melbourne, Fla.

[21] Appl. No.: 431,010

[22] Filed: Sep. 30, 1982

[51] Int. Cl.[3] ..... B41F 13/14; B41F 13/28; B41F 13/38; B41F 13/34

[52] U.S. Cl. ..... 101/247; 101/218; 101/352

[58] Field of Search ..... 101/218, 244, 248, 351, 101/352

[56] References Cited

U.S. PATENT DOCUMENTS

| | | | |
|---|---|---|---|
| 2,635,539 | 4/1953 | Peyrebrune | 101/352 |
| 2,737,886 | 3/1956 | Ruppel | 101/351 |
| 2,853,943 | 9/1958 | Royer | 101/352 |
| 2,855,846 | 10/1958 | Harless et al. | 101/218 |
| 2,874,636 | 2/1959 | Royer et al. | 101/247 |
| 3,208,377 | 9/1965 | Hantscho | 101/248 |
| 3,691,956 | 9/1972 | James et al. | 101/352 |
| 3,800,698 | 4/1974 | Kist et al. | 101/247 |
| 4,094,243 | 6/1978 | Brann | 101/218 |
| 4,214,527 | 7/1980 | Kamota | 101/247 |

*Primary Examiner*—William Pieprz

*Attorney, Agent, or Firm*—Yount & Tarolli

[57] ABSTRACT

A rotary printing press comprises a rotatable blanket cylinder and a plate cylinder disposed in rolling engagement with said blanket cylinder. A skew-adjusting means varies the angle between the blanket and plate cylinders. A form roll is disposed in rolling engagement with the plate cylinder. Plate cylinder throw off means moves the plate cylinder to disengage the plate cylinder from the blanket cylinder. The plate cylinder throw off means comprises means for disengagement of said plate cylinder from said blanket cylinder without skew movement of the plate cylinder. Form roll-plate cylinder adjustment means is provided for adjusting the center-to-center distance between the form roll and the plate cylinder. A cam has surface means for maintaining the center-to-center distance between the form roll and the plate cylinder as the plate cylinder is thrown off the blanket cylinder and as the skew adjusting means varies the angle between said blanket and plate cylinders.

15 Claims, 4 Drawing Figures

ROTARY PRINTING PRESS

BACKGROUND AND SUMMARY OF THE INVENTION

The present invention relates to rotary printing presses, and in particular the present invention relates to a rotary offset printing press having at least one plate cylinder and at least one blanket cylinder.

In a rotary offset printing press the plate cylinder is disposed in rolling engagement with the blanket cylinder which in turn contacts the web or sheet to be printed. The web or sheet is backed by either an impression cylinder or, in the case of a perfecting press, another blanket cylinder.

There are various known general constructions of offset printing presses, and each of these enables the cylinders to be separated or thrown off from each other. This has been done by mounting one of the cylinders in eccentric bushings called throw off eccentrics. In one common general construction the blanket cylinder is mounted in throw off eccentrics, and throw off is achieved by movement of the blanket cylinder relative to the plate cylinder and the frame. In another general construction the plate cylinder is mounted in the throw off eccentrics so that throw off is achieved by movement of the plate cylinder relative to the press frame and blanket cylinder while the blanket cylinder remains stationary. This arrangement has been used in perfecting presses in which the plate cylinders and blanket cylinders rotate about axes which lie in a common plane.

In addition to mounting the plate and blanket cylinders so that they are relatively movable for purposes of throw off, it has also been a common practice to mount the plate cylinder so that it may be skewed relative to the blanket cylinder. To this end, the plate cylinder has been mounted at each end in self-aligning bearings, and at one end the self-aligning bearing is mounted in an eccentric called the skew eccentric. When the skew eccentric is rotated, the end of the plate cylinder which it supports moves in an arcuate path and the other end of the plate cylinder pivots about the self-aligning bearing supporting that end. This varies or skews the line of contact between the plate and blanket cylinders. Skew adjustment provides proper registration in the event that the printing plate is improperly aligned when attached to the plate cylinder, as is well known in the art.

Ink is applied to the plate cylinder by a rubber form roll which runs in engagement with the plate cylinder. The amount of ink which adheres to the plate depends in part on the contact pressure between the form roll and the printing plate. Rotary presses have means for adjusting the center-to-center distance between the form roll and the plate cylinder to vary the contact pressure. Because the form roll contact pressure adjustment is sensitive, skew movement of the plate cylinder changes the form roll contact pressure adjustment. To overcome this difficulty, numerous devices have been designed to enable the form roll to plate cylinder center-to-center distance to be maintained during skew movement of the plate cylinder. Examples of such devices may be found in U.S. Pat. Nos. 3,538,849 and 4,214,527.

In preparing a rotary printing press for operation it is desirable to be able to throw the form roll into and out of rolling engagement with the plate cylinder. Once the center to center distance between the form roll and plate cylinder has been adjusted, it is desirable to be able to throw off the form roll and to return it to engagement with the plate cylinder to the previously selected distance. Devices to accomplish this are also disclosed in the above-mentioned U.S. patents.

To the applicant's knowledge there are no printing presses in which the plate cylinder is moved for throw off from the blanket cylinder and may be skewed relative to the blanket cylinder and in which the form roll adjustment is automatically maintained during throw off and skewing of the plate cylinder.

The present invention comprises a rotary offset printing press in which a plate cylinder is mounted in eccentrics for the purpose of throwing off the plate cylinder from a blanket cylinder. In addition, one end of the plate cylinder is mounted in an eccentric for making skew adjustments of the plate cylinder relative to the blanket cylinder. A form roll is mounted in rolling contact with the plate cylinder, and the center-to-center distance between the form roll and the plate cylinder may be adjusted to achieve a desired contact pressure and the adjustment is maintained during both throw off and skewing of the plate cylinder.

A cam is provided at each end of the plate cylinder. The cams are rotatable about the axis of the plate cylinder and they are mounted on the bearings which support the plate cylinder. Therefore, the cams move whenever the plate cylinder is moved, either for throw off from the blanket cylinder or for skew adjustment. Moreover, the cams are rotatable independently of both the skew and plate throw off eccentrics for throwing the form roll off the plate cylinder. Therefore, throwing off the plate cylinder does not effect the form roll to plate cylinder center-to-center adjustment, and the form roll can be thrown on or off the plate cylinder whether or not the plate cylinder is thrown on or off of the blanket cylinder.

BRIEF DESCRIPTION OF THE DRAWINGS

These and other features of the present invention will become clear to those skilled in the art to which it relates upon consideration of the following specification together with the accompanying drawings in which.

DESCRIPTION OF PREFERRED EMBODIMENTS

Figure 1:
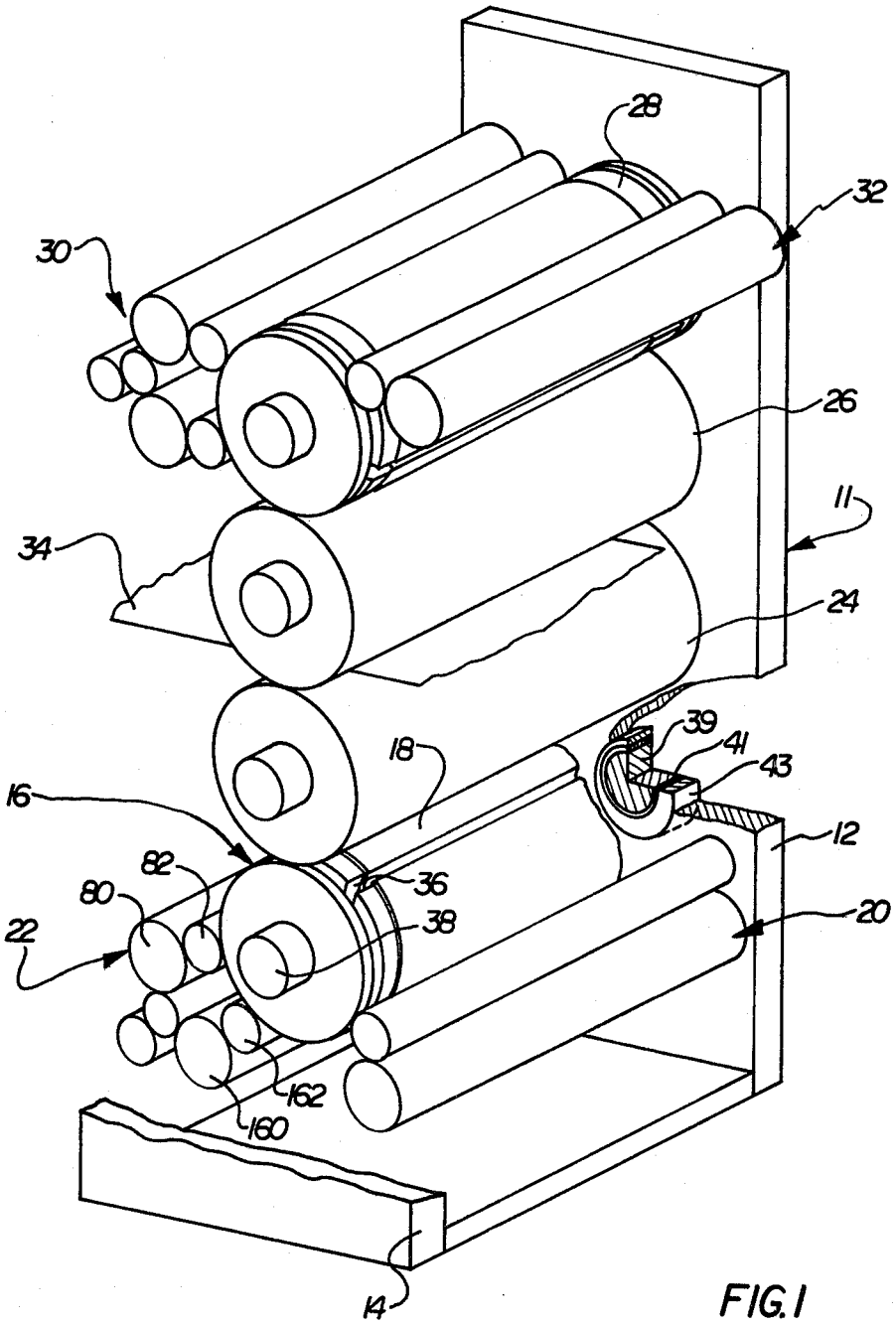
FIG. 1 is a schematic illustration of a rotary printing press constructed in accordance with the present invention.

FIG. 1 illustrates schematically a portion of a rotary offset printing press 10 constructed in accordance with the present invention. The printing press 10 is a perfecting press and includes a frame 11 having side members 12 and 14. A plate cylinder 16 is mounted between the side members 12 and 14, and a printing plate 18 is mounted on the plate cylinder. The plate 18 is dampened by a dampener assembly 20 and ink is applied by an inker assembly 22 as the plate cylinder 16 rotates. The inked image on the plate 18 is then offset onto a blanket cylinder 24. Together the plate cylinder 16 and blanket cylinder 24 comprise a lower printing couple.

An additional, upper printing couple includes a blanket cylinder 26 and a plate cylinder 28. Blanket and plate cylinders 26 and 28 are mounted above cylinders 16 and 24, and the axes of rotation of all the cylinders 16, 24, 26, and 28 are substantially co-planar. An inker assembly 30 and dampener assembly 32 are also provided which apply ink and dampener solution, respectively, to a printing plate 33 mounted on the upper plate cylinder 28. A web 34 of paper is fed between the blanket cylinders 24 and 26 so that the inked impression is transferred from the blanket cylinder 24 to the web 26. Similarly, an inked impression from the plate 33 on the plate cylinder 28 is offset onto blanket cylinder 24 and printed on the opposite side of web 34.

The blanket cylinder 24 rotates about an axis which is fixed with respect to the frame members 12 and 14. The blanket cylinder 26 is mounted in eccentrics in the frame members 12 and 14 so that the blanket cylinders 24 and 26 may be separated. Except for the mounting of blanket cylinder 26 in eccentrics, the operation of the upper printing couple 26, 28 is substantially the same as the operation of the lower printing couple 16, 24. Therefore, although the description that follows is in terms of the lower couple 16, 24 and its associated dampener and inker assemblies 20 and 22, it will be understood to apply equally to the upper printing couple 26, 28 and its associated inker and dampener assemblies 30 and 32.

The plate cylinder 16 has a cylindrical outside surface interrupted by a gap 36 in which the ends of the printing plate 18 are inserted and clamped. Stub shaft 38 extends outward and coaxial with the plate cylinder 16 from the end of the plate cylinder adjacent the side member 14 of the frame 11. A corresponding stub shaft 39 extends from the end of the plate cylinder 16 adjacent the side member 12 of the frame 11. The stub shaft 38 is journaled in a self-aligning bearing 40 (FIGS. 2 and 3) and the stub shaft 39 (FIG. 1) on the opposite end of the plate cylinder 16 is journaled in a similar self-aligning bearing 41 (FIG. 1).

Two adjustments are provided to vary the position of the plate cylinder 16 with respect to the frame 11 and the blanket cylinder 24. The first of these is a throw off mechanism. The bearing 40 (FIG. 2) supporting stub shaft 38 is received in an eccentric throw off bushing 42. A similar eccentric throw off bushing 43 (FIG. 1) supports the bearing 41 which supports stub shaft 39 at the opposite end of the plate cylinder 16. When the throw off eccentrics 42 and 43 are rotated, the axis 50 of the plate cylinder 16 travels along an arc centered on an axis 56 (FIG. 2) which is concentric with the outside surface 58 of the throw off eccentric 42. This moves the plate cylinder 16 into or out of engagement with the blanket cylinder 24.

A cleavis 60 (FIG. 3) extends radially outward from the throw off eccentric 42 to rotate the throw off eccentric. A turnbuckle 62 forms the output of a toggle linkage (not shown) which is operated to move the plate cylinder 16 between thrown on and thrown off positions. The turnbuckle 62 is adjustable lengthwise to select the final thrown on position of the plate cylinder 16 which thereby controls the pressure with which the plate cylinder 16 engages blanket cylinder 24. A similar mechanism (not shown) is used to actuate eccentric 43 at the opposite end of the plate cylinder.

Figure 2:
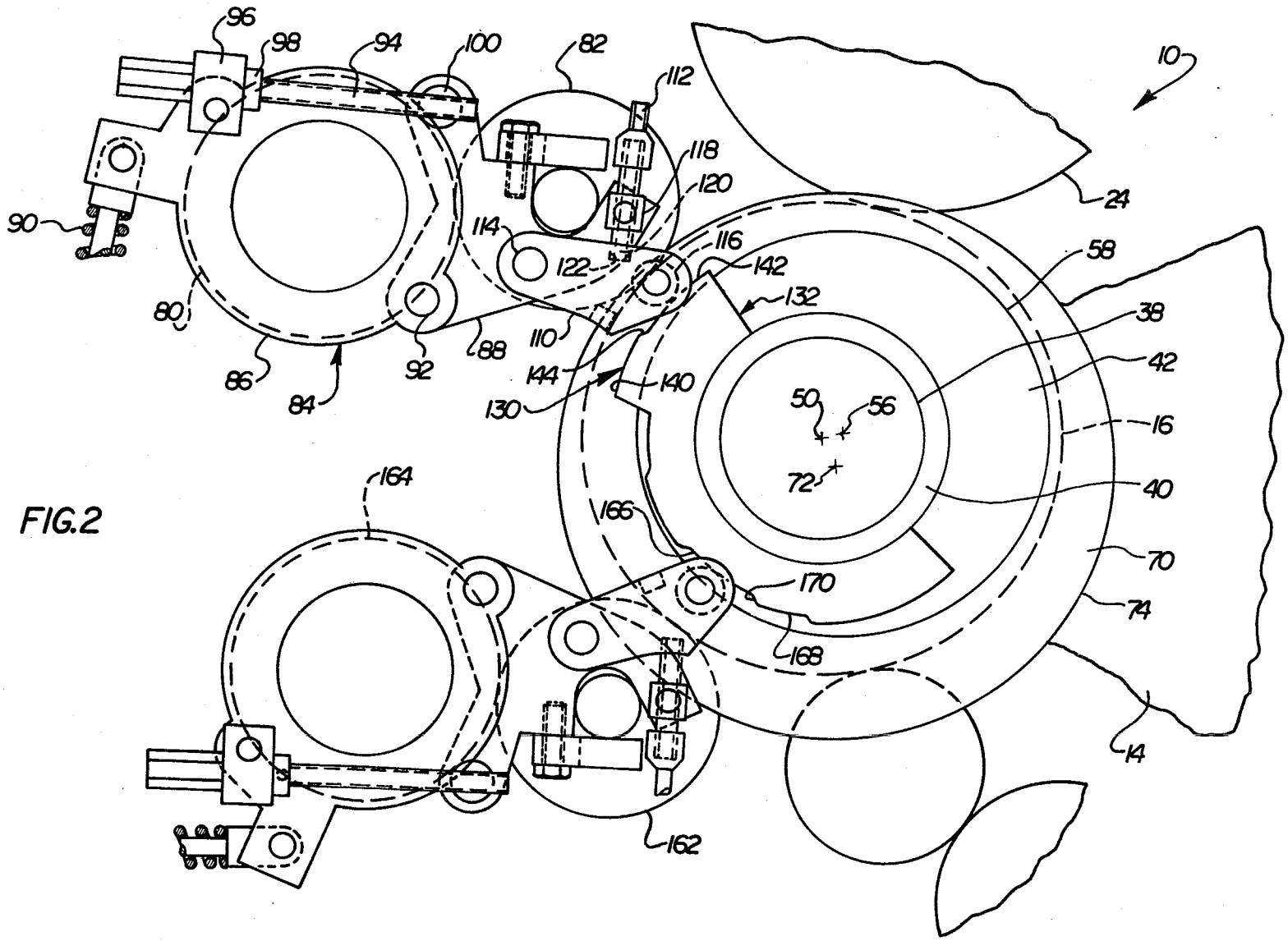
FIG. 2 is a side elevation view of a portion of the press of FIG. 1 showing details now shown in FIG. 1.
Figure 3:
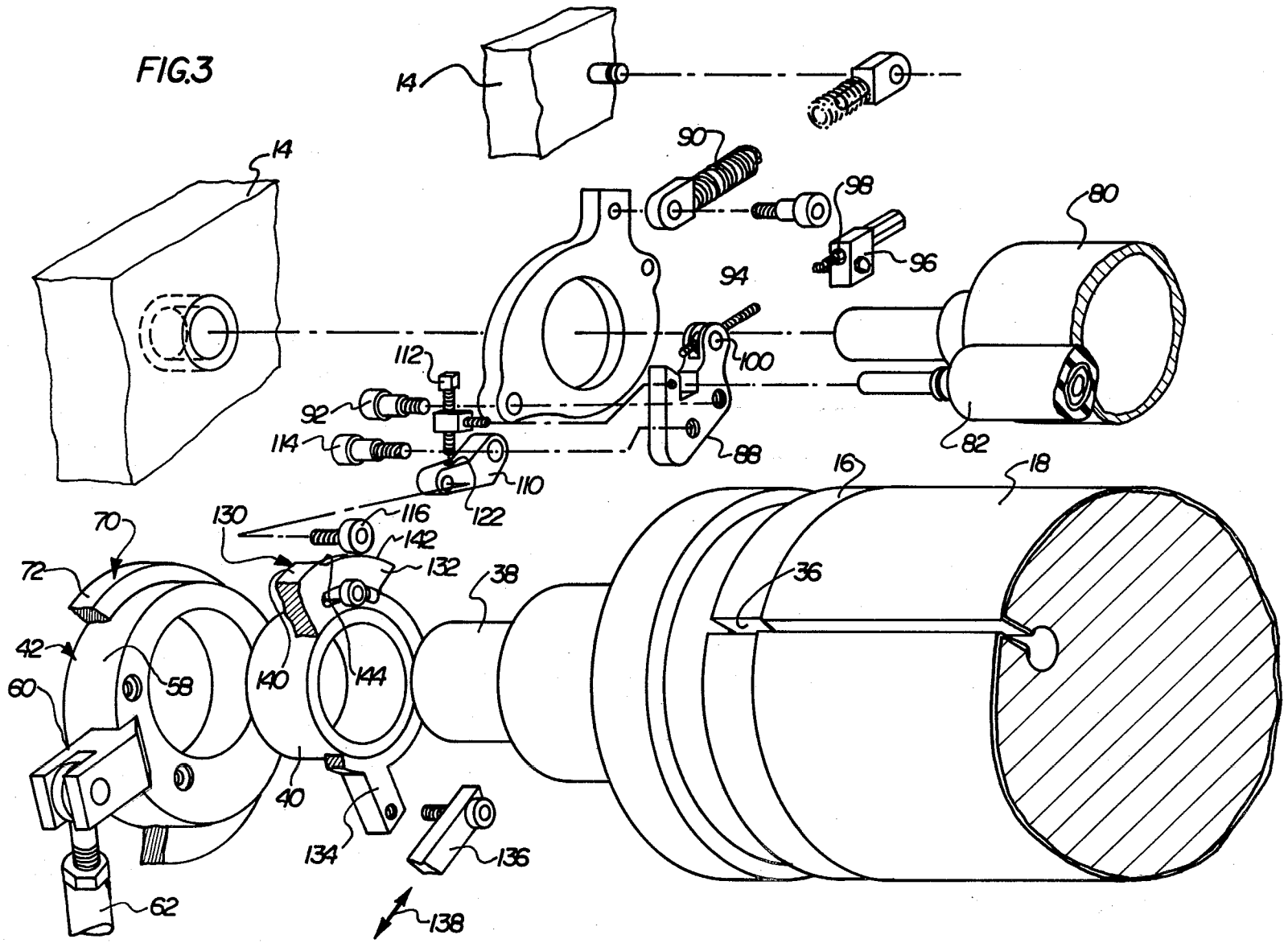
FIG. 3 is an exploded perspective illustration of a portion of the press of FIG. 1.

The second adjustment of the position of the plate cylinder 16 with respect to the frame 11 (FIG. 1) and the blanket cylinder 24 is for skew. On the side of the press adjacent frame member 14 the throw off eccentric 42 is itself rotatably mounted in a skewing eccentric 70 (FIG. 2). When the skewing eccentric 70 is rotated, the stub shaft 38 of the plate cylinder 16 travels along an arc centered about the axis 72 of the outside perimeter 74 of the skewing eccentric, and the stub shaft 39 (FIG. 1) pivots about the bearing 41. In this manner the plate cylinder 16 can be moved out of exact parallelism with the axis of the blanket cylinder 24. This skewing can correct for misalignments of the printing plate 18 on the plate cylinder 16, as is well known in the art.

The printing press 10 includes an inker assembly 22 (FIG. 1) to apply ink from an ink supply to ink-receptive portions of the printing plate 18. The inker assembly 22 includes a vibrator roll 80 which is mounted for rotation about an axis which is fixed with respect to the frame 11. A form roll 82 is disposed in rolling engagement with the vibrator roll 80 and with plate cylinder 16 to transfer ink from the vibrator roll 80 to the printing plate 18.

The form roll 82 (FIG. 2) is mounted in a hanger assembly 84 which is mounted for pivotal movement about the axis of vibrator roll 80. The hanger assembly 84 includes a pivot bracket 86 which is mounted for pivotal movement about the axis of the vibrator roll 80. The hanger assembly 84 also includes a form roll hanger 88 which supports the form roll 82 and which is pivotally connected to the pivot bracket 86. A spring 90 is connected between the frame 11 and the hanger assembly 84 and urges the hanger assembly toward the plate cylinder 16.

The form roll 82 is coated with rubber, and how much ink is transferred from the form roll to the plate cylinder 16 depends in part on the contact pressure between the vibrator roll 80 and the form roll 82 and between the form roll 82 and the plate cylinder 16. Adjustments to these contact pressures is accomplished by varying the center-to-center distances between the respective rolls.

To adjust the center-to-center distance between the vibrator roll 80 and the form roll 82, the form roll hanger 88 is pivotable about the axis of shoulder bolt 92. By varying the angle of the form roll hanger 88 with respect to the pivot bracket 86, i.e., the angle formed between the centers of the form roll 82, shoulder bolt 92 and vibrator roll 80, the contact pressure between the vibrator roll 80 and the form roll 82 may be varied. To this end a threaded shaft 94 passes through a block 96 which is pivotably mounted to the pivot bracket 86. The shaft 94 is held against axial movement by a collar 98 and is received in a nut 100 which is pivotably connected with the form roll hanger 88. By rotating the threaded shaft 94, the angle between the pivot bracket 86 and the form roll hanger 88 can be varied to thereby vary the center-to-center distance between the vibrator roll 80 and form roll 82 and the contact pressure between them.

A pivotable arm 110 and adjusting screw 112 provide for adjustment of the center-to-center distance between the form roll 82 and the plate cylinder 16 and therefore the contact pressure between them. The arm 110 is pivotable about the axis of shoulder bolt 114 which is secured to the pivot bracket 86. The arm 110 carries a cam follower 116 at its end portion remote from the shoulder bolt 114. The adjusting screw 112 is received in a nut 118 which is pivotably connected with the form roll hanger 88. One end 120 of the adjusting screw 112 is received in a shallow recess 122 in the arm 110. By turning the adjusting screw 112 the angle between the arm 116 and the form roll hanger 88, i.e., the angle between the centers of the cam follower 116, shoulder bolt 114 and form roll 82, can be varied.

As previously mentioned, the arm 110 carries a cam follower 116. This cam follower 116 bears against the surface 130 of a cam 132 (to be discussed more fully below). When the arm 110 pivots because of rotation of the adjusting screw 112, the form roll 82 is pushed away from the plate cylinder 16 or allowed to move closer thereto under the influence of the biasing spring 90. This varies the center-to-center distance between the form roll 82 and the plate cylinder 16, thereby varying the amount of ink transferred from the form roll 82 to the printing plate 18. This does not change the previously described adjustment between the form roll 82 and vibrator roll 80. Turning the adjusting screw 112 causes the pivot bracket 86 to turn about the axis of the vibrator roll 80, but the center-to-center distance between the vibrator and form rolls does not change.

The previously mentioned cam surface 130 is formed on a cam 132. The cam 132 not only provides a means for throwing the form roll 82 from the plate cylinder 16 but also enables the form roll to follow skew movement of the plate cylinder without loss of the form roll contact pressure adjustment. The cam 132 (FIGS. 2 and 3) is mounted for rotation about the axis of the plate cylinder 16. An arm 134 (FIG. 3) extends radially outward from the cam 132, and a throw off lever 136 is pivotably connected with the arm. When the lever 136 is moved in the direction of arrow 138, the cam 132 rotates about the axis of the plate cylinder 16.

The cam surface 130 includes two concentric surfaces 140 and 142 on which the cam follower 116 may bear. The cam surfaces 140 and 142 are concentric with the plate cylinder 16, and an inclined surface 144 connects the two cam surfaces 140 and 142. When the cam 132 is rotated clockwise (as viewed in FIG. 2) about the axis 50 of the plate cylinder by actuation of the form roll throw off lever 136, the cam follower 116 moves from the radially inner surface 142 of the cam up, i.e., radially outward on, the inclined portion 144 to the radially outer surface 140. This pivots the entire hanger assembly 84 counterclockwise (as viewed in FIG. 2) about the axis of the vibrator roll 80 and lifts the form roll 82 from the surface of the plate cylinder 16. When the cam 132 is rotated counterclockwise back to the position shown in FIG. 2, the cam follower 116 moves across the inclined surface 144 back to the radially inner cam surface 142 and the form roll 82 moves back into contact with the plate cylinder 16 at the same center-to-center distance from the plate cylinder and with the same contact pressure as before.

The form roll throw off mechanism is operable whether or not the plate cylinder 16 is in contact with or thrown off from the blanket cylinder 24. During throw off of the plate cylinder 16 from the blanket cylinder 24 and with the form roll 82 thrown on, i.e., in contact with the plate cylinder, the cam follower 116 traverses the radially inner cam surface 142 as the plate cylinder 16 pivots about the center 56 of the throw off eccentric 42. Similarly, when the form roll 82 is thrown off from the plate cylinder 16 and therefore the cam follower 116 is on the radially outer cam surface 140, movement of the plate cylinder 16 about the throw off axis 56 causes the cam follower 116 to traverse the outer cam surface 140 but not to move onto the inclined surface 144. The cam surfaces 140 and 142 each have sufficient arcuate extent that throwing the plate cylinder 16 on or off the blanket cylinder 24 does not cause the cam follower 116 to move up or down the ramp 144 on the cam 132. On the other hand, the form roll throw off lever 136 moves a sufficient distance to cause rotation of the cam 132 of a sufficient degree that the cam follower 116 will cause the cam follower 116 to move up or down the inclined portion 144 of the cam surface 130 regardless of whether the plate cylinder 16 is thrown on or thrown off from the blanket cylinder 24.

When the skew eccentric 70 is rotated, one end of the plate cylinder 16 pivots about the axis 72 of the outside perimeter 74 of the skew eccentric while the other end pivots about the axial center of bearing 41 (FIG. 1) as previously described. This movement changes the angle between the axis 50 of the plate cylinder 16 and the axis of the blanket cylinder 24, but the contact pressure between the form roll 82 and the plate cylinder 16 does not change. The point of contact between the cam follower 116 and the cam surface 130 lies approximately along with a line connecting the centers of the form roll 82 and the plate cylinder 16. When the skew eccentric 70 is rotated to move one end of the plate cylinder 16, the cam surface 130 moves also, retaining its relationship with the plate cylinder. The spring 90 biases the cam follower 116 into contact with the cam surface 130 just as it does when the plate cylinder moves during throw off of the plate cylinder from the blanket cylinder discussed above. The form roll 82 thus follows the plate cylinder 16 as the plate cylinder moves in a skew direction. This enables skew adjustments to be made independently of the form roll-plate cylinder contact pressure adjustment. The cam surfaces 140 and 142 are relatively long compared to the amount of skew movement of the plate cylinder 16. Therefore when the plate cylinder 16 is skewed, the cam follower traverses a small portion of the surface 140 or 142 (depending on whether the form roll 82 is thrown on or thrown off) but does not cross the inclined surface 144.

The inker assembly 22 (FIG. 1) may include additional vibrator rolls, such as roll 160, and additional form rolls, such as roll 162. To avoid prolixity of description, these rolls and their mounting are not described further, except to say that they are mounted and operated in the same manner as vibrator roll 80 and form roll 82. In the event of the provision of such additional rolls, the cam 132 would include additional cam surfaces 166 and 168 concentric with the surface of the plate cylinder 16 and connected by an inclined surface 170, as would be obvious to those of ordinary skill in the art.

Figure 4:
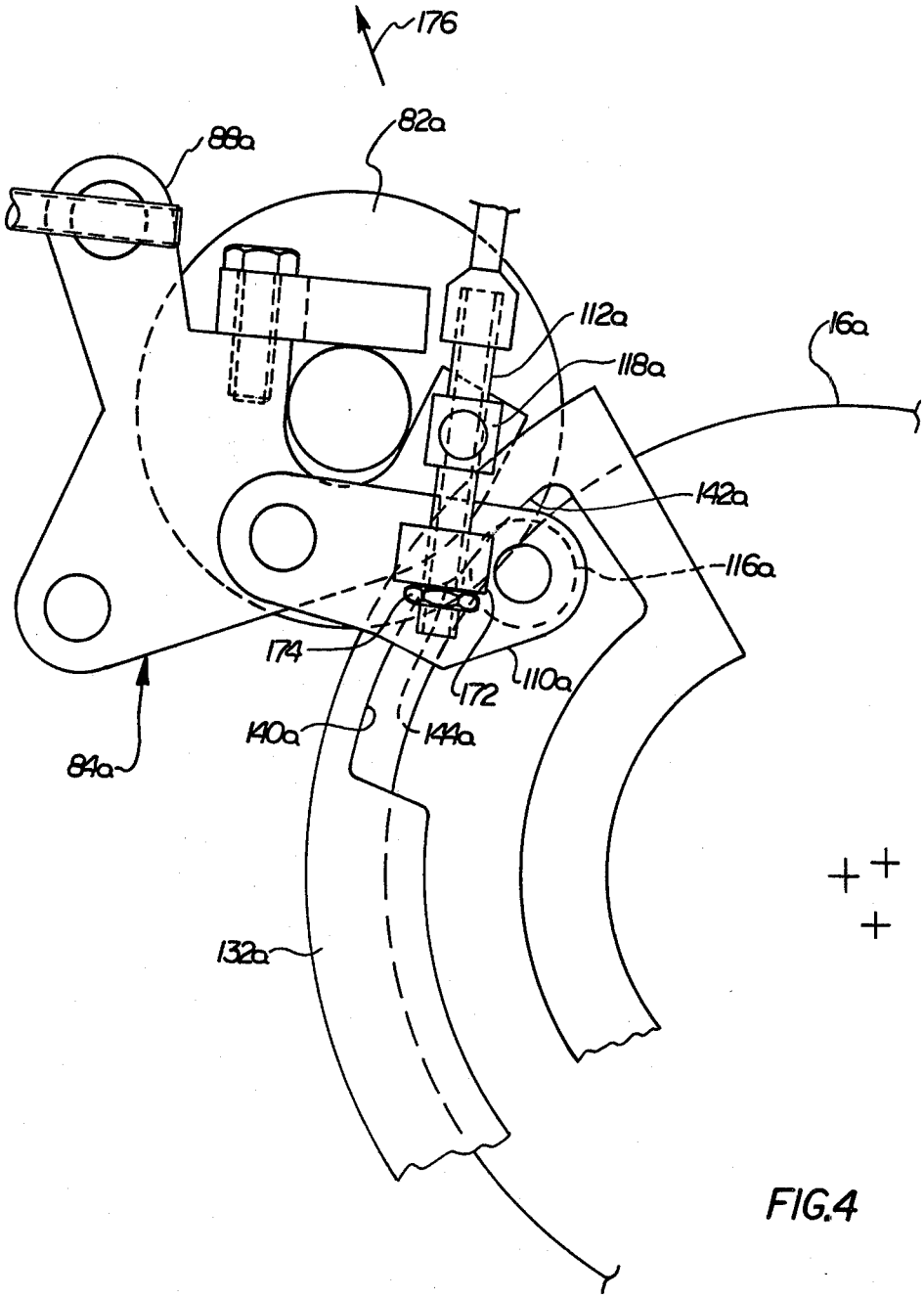
FIG. 4 illustrates an alternative embodiment of a portion of the printing press of FIG. 1.

FIG. 4 illustrates a second preferred embodiment of the present invention in which similar numerals with the suffix "a" appended are used to describe similar components. In the embodiment illustrated in FIG. 4, the cam follower **116*a* bears against a cam 132*a* having cam surfaces 140*a* and 142*a* which are concave rather than convex. This arrangement provides for positive engagement of the form roll 82*a* with the surface of the plate cylinder 16*a*. Changes are necessary to the hanger assembly 84*a* so that the angular relationship between the arm 110*a* and the form roll hanger 88*a* will not change except upon rotation of the adjusting screw 112*a*. To this end, the adjusting screw 112*a* is received in a nut 118*a* which is pivotably connected with the form roll hanger 88*a*. The end portion 120*a* of the adjusting screw 112*a* is slidably received in a passage 160 through a block 172** which is pivotably connected with the arm 110*a*. A collar 174 prevents axial movement of the screw 112*a* with respect to the block 172 in an upward direction as viewed in FIG. 4. In addition, the action of the spring 90 is reversed so that it biases the hanger assembly 89*a* away from the plate cylinder 16*a* in the direction of arrow 176. Therefore, as the adjusting screw 112*a* is turned the arm 110*a* pivots about the axis of shoulder bolt 114*a*, and when the cam 132 is rotated clockwise as viewed in FIG. 4, the cam follower 116*a* moves radially outward, biased by the spring 90 in the direction of arrow 176. When the cam 132*a* is turned counterclockwise, the cam follower 116*a* is forced radially intwardly by the ramp 144*a*.

Thus, it is clear that the present invention comprises a rotary printing press 10 (FIG. 2) in which a plate cylinder 16 is mounted in eccentrics 42 and 43 (FIG. 1) for the purpose of throwing the plate cylinder 16 off from a blanket cylinder 24. In addition, one end portion of the plate cylinder 16 is mounted in a skew eccentric 70 (FIG. 2) for making skew adjustments. A form roll 82 is mounted in rolling contact with the plate cylinder 16, and the center-to-center distance between the form roll 82 and the plate cylinder 16 may be adjusted to achieve a desired contact pressure. A rotatable cam 132 provides means for throwing the form roll 82 off the plate cylinder 16 and returning it into contact with the plate cylinder with the previously adjusted contact pressure. Moreover, the cam surfaces 140 and 142 are sufficiently long that the previously adjusted contact pressure is maintained when the skew eccentric 70 is rotated. The form roll throw off means and the plate cylinder throw off eccentrics 42 and 43 are independently operable so that throwing off the plate cylinder from the blanket cylinder 24 does not effect the form roll contact pressure adjustment, and the form roll 82 can be thrown on or off the plate cylinder 16 whether or not the plate cylinder is thrown on or off the blanket cylinder.

Although the present invention has been described as embodied in off set printing presses, the invention may also be applicable to other types of printing presses.

The following is claimed:

1. A rotary printing press comprising a frame, a first cylinder rotatably supported in said frame, a second cylinder rotatably supported in said frame, throw off means actuatable to throw off said second cylinder from said first cylinder, skew means for effecting skew movement of said second cylinder with respect to said first cylinder, said throw off means comprising means for effecting throw off of said second cylinder from said first cylinder without skew movement of said second cylinder, a rotatable form roll, means for supporting said form roll in said frame, means for adjusting the center-to-center distance between said form roll and said second cylinder to a desired distance, and means for maintaining said desired center-to-center distance between said form roll and said second cylinder during skew movement of said second cylinder and during throw off of said second cylinder from said first cylinder.

2. A rotary printing press as defined in claim 1 wherein said means for maintaining said desired center-to-center distance also separates said form roll from said second cylinder.

3. A rotary press as set forth in claim 2 wherein said means for supporting said form roll in said frame includes pivot bracket means for supporting said form roll for movement along an arcuate path with respect to said frame and a cam follower connected with said pivot bracket means, said means for maintaining said desired center-to-center distance between said form roll and said second cylinder during skew movement of said second cylinder and during throw off of said second cylinder from first blanket cylinder and for separating said form roll from said second cylinder includes a rotatable cam having first and second surfaces, said first and second surfaces cooperating to maintain said cam follower at either one of two radial distances from the center of said second cylinder during throw off movement of said second cylinder and during skew movement of said second cylinder, and a third surface connecting said first and second surfaces, said cam follower traversing said third surface upon rotation of said cam to thereby effect throw off of said form roll from said second cylinder.

4. A rotary press as set forth in claim 3 wherein said first and second surfaces are concentric with said second cylinder, said second surface being radially displaced from said first surface, and said third surface is an inclined surface connecting said first and second surfaces, and said cam being rotatable about the axis of said plate cylinder and with respect thereto.

5. A rotary printing press comprising a rotatable blanket cylinder, a plate cylinder disposed in rolling engagement with said blanket cylinder, skew-adjusting means for varying the angle between said blanket and plate cylinders, a form roll disposed in rolling engagement with said plate cylinder, plate cylinder throw off means for moving said plate cylinder to disengage said plate cylinder from said blanket cylinder, said plate cylinder throw off means comprising means for disengagement of said plate cylinder from said blanket cylinder without skew movement of said plate cylinder, form roll-plate cylinder adjustment means for adjusting the center-to-center distance between said form roll and said plate cylinder, and a cam having surface means for maintaining the center-to-center distance between said form roll and said plate cylinder as said plate cylinder is thrown off said blanket cylinder and as said skew adjusting means varies the angle between said blanket and plate cylinders.

6. A rotary printing press as defined in claim 5 wherein said surface means also moves said form roll with respect to said plate cylinder to disengage said form roll from said plate cylinder.

7. A rotary printing press as set forth in claim 6 further including a hanger assembly pivotably mounted in said frame and supporting said form roll, said cam being mounted for rotation about the axis of said plate cylinder and including two cam surfaces concentric with said plate cylinder, one of said cam surfaces being radially displaced from the other, and an inclined surface connecting said concentric cam surfaces, and said hanger assembly including a cam follower disposed in engagement with said cam.

8. A rotary printing press as set forth in claim 7 further including means for rotating said cam to cause said cam follower to traverse said inclined surface.

9. A rotary press as set forth in claim 8 further including a vibrator roll and wherein said hanger assembly includes a pivot bracket mounted for rotation about the axis of said vibrator roll, a form roll hanger pivotably connected with said roll hanger bracket, and vibrator roll-form roll contact adjustment means for varying the center to center distance between said form roll and said vibrator roll.

10. A rotary press as set forth in claim 9 further including biasing means for urging said cam follower into engagement with said cam, said biasing means acting between said frame and said pivot bracket.

11. A rotary printing press as set forth in claim 10 wherein said form roll-plate cylinder adjustment means includes a follower arm pivotably connected with said form roll hanger, said cam follower being connected with said follower arm, and means for adjusting the angle between said follower arm and said form roll hanger.

12. A rotary printing press as set forth in claim 5 wherein said plate cylinder throw-off means includes a pair of rotatable throw-off eccentrics supporting opposite end portions of said plate cylinder and said skew adjusting means includes a rotatable skew eccentric supporting one end portion of said plate cylinder.

13. A rotary printing press as set forth in claim 12 wherein one of said throw off eccentrics is supported by said skew eccentric.

14. A rotary printing press as defined in claim 1 wherein said second cylinder includes a concentric shaft rotatably supported in said throw off means, said throw off means being rotatably supported in said skew means, and said means for maintaining said desired center-to-center distance between said form roll and said second cylinder comprises a cam means that moves with said concentric shaft during the skew movement of said second cylinder and during the throw off of said second cylinder from said first cylinder.

15. A rotary printing press as defined in claim 14 wherein said concentric shaft is mounted in a bearing received in said throw off means, and said cam means is mounted on said bearing.

* * * * *